US010200802B1

(12) United States Patent
Diehl

(10) Patent No.: US 10,200,802 B1
(45) Date of Patent: Feb. 5, 2019

(54) INVERTED BUTTON CAP IN ACOUSTIC TRANSDUCER

(71) Applicant: BOSE CORPORATION, Framingham, MA (US)

(72) Inventor: Scott Diehl, Marlborough, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/667,856

(22) Filed: Aug. 3, 2017

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 31/00*** | (2006.01) |
| ***H04R 1/02*** | (2006.01) |
| ***H04R 7/16*** | (2006.01) |
| ***H04R 9/04*** | (2006.01) |

(52) U.S. Cl.
CPC ..... *H04R 31/006* (2013.01); *H04R 1/02* (2013.01); *H04R 7/16* (2013.01); *H04R 9/046* (2013.01); *H04R 2201/02* (2013.01); *H04R 2307/207* (2013.01)

(58) Field of Classification Search
CPC ..... H04R 1/02; H04R 2201/02; H04R 2307/207; H04R 31/006; H04R 7/16; H04R 9/046
USPC ..... 381/398
See application file for complete search history.

(56) References Cited

U.S. PATENT DOCUMENTS

| | | | | |
|---|---|---|---|---|
| 8,139,811 | B2 * | 3/2012 | Itoh | H04R 9/02 181/157 |
| 8,213,671 | B2 * | 7/2012 | Matsuda | H04R 9/06 181/157 |
| 9,479,874 | B2 * | 10/2016 | Shikimachi | H04R 1/2834 |
| 2006/0120554 | A1 | 6/2006 | Watanabe | |
| 2008/0279415 | A1 | 11/2008 | Roemer et al. | |
| 2010/0002901 | A1 * | 1/2010 | Matsuda | H04R 9/06 381/398 |
| 2010/0177925 | A1 * | 7/2010 | Furuto | H04R 7/12 381/398 |
| 2010/0208934 | A1 * | 8/2010 | Dohi | H04R 7/12 381/398 |
| 2012/0195457 | A1 * | 8/2012 | Shin | H04R 7/122 381/398 |
| 2015/0117698 | A1 * | 4/2015 | Bullimore | H04R 7/16 381/398 |

(Continued)

FOREIGN PATENT DOCUMENTS

WO 20070046230 A1 4/2007

OTHER PUBLICATIONS

International Search Report and Written Opinion for International Application No. PCT/US2018/039475, dated Aug. 31, 2018.

*Primary Examiner* — Khai N. Nguyen

(74) *Attorney, Agent, or Firm* — Patterson + Sheridan, LLP

(57) ABSTRACT

An inverted button cap of an electroacoustic transducer has a diaphragm, a bobbin coupled to the diaphragm, and a dust cap supported by the bobbin and coupled to the diaphragm via the bobbin. The dust cap includes a concave surface that faces outwardly away from the bobbin. According to an example, an adhesive joint couples the diaphragm, dust cap, and the bobbin to provide a seal at the junction of the diaphragm and the bobbin. A convex surface of the dust cap, opposite the concave surface, extends into a cavity formed by the bobbin.

13 Claims, 2 Drawing Sheets

(56) References Cited

U.S. PATENT DOCUMENTS

Figure 1:
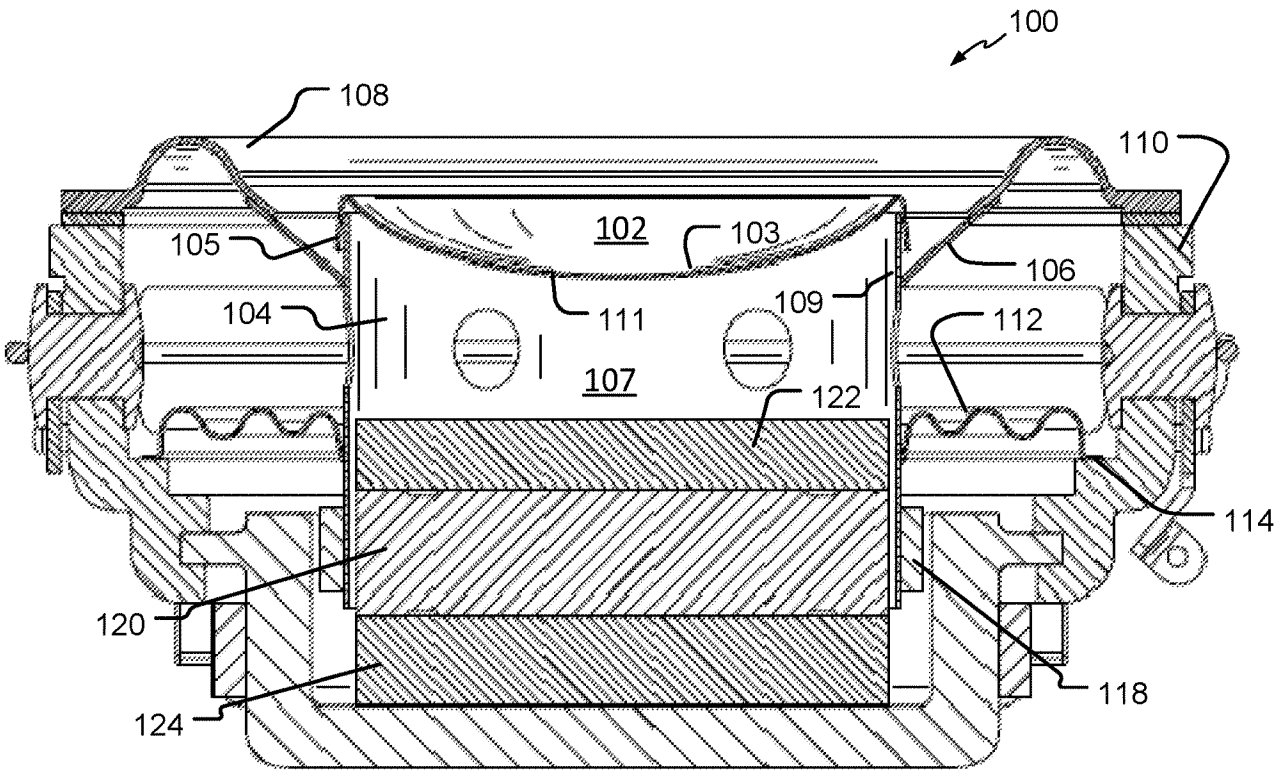

2016/0277839 A1* 9/2016 Shikimachi ..... H04R 1/2834
2017/0374439 A1* 12/2017 Watanabe ..... H04R 1/02

* cited by examiner

INVERTED BUTTON CAP IN ACOUSTIC TRANSDUCER

I. FIELD OF THE DISCLOSURE

The present disclosure relates generally to electroacoustic transducers, and more particularly, to dust caps used in speaker drivers.

II. BACKGROUND

A dust cap is used to close off the open end of voice coil/bobbin assembly of electroacoustic transducer to prevent dust, debris, and moisture from infiltrating the motor structure. The dust cap also contributes to the acoustic output in traditional transducer designs.

III. SUMMARY OF THE DISCLOSURE

All examples and features motioned herein can be combined in any technically possible manner.

According to a particular aspect, an electroacoustic transducer comprising a diaphragm, a bobbin coupled to the diaphragm, and a dust cap supported by the bobbin and coupled to the diaphragm via the bobbin. The dust cap includes a concave surface that faces outwardly away from the bobbin.

In one example, the dust cap includes a flange surface that circumferentially surrounds a first end portion of the bobbin. According to another example, the dust cap includes a cylindrical flange surface. The flange surface contacts an exterior circumference of the bobbin. According to another example, a flange surface contacts an interior surface of the bobbin. The flange surface extends in a substantially parallel direction to a surface of the bobbin. The dust cap includes a lip that extends outwardly from the flange surface. An adhesive layer may be used to couple the dust cap to the bobbin. The bobbin comprises a hollow cylinder, and wherein the dust cap includes a cylindrical wall disposed around a periphery of the concave surface, wherein the cylindrical wall concentrically surrounds a first end portion of the hollow cylinder.

According to another example, an adhesive joint couples the diaphragm and the bobbin and providing a watertight seal at the junction of the diaphragm and the bobbin. A convex surface of the dust cap, opposite the concave surface, extends into a cavity formed by the bobbin. A voice coil is wound around the bobbin.

According to another particular aspect, an apparatus includes a diaphragm and a bobbin coupled to the diaphragm, as well as a dust cap supported by the bobbin and coupled to the diaphragm via the bobbin. The dust cap includes a concave surface that faces outwardly away from the bobbin, where the dust cap includes a flange surface that circumferentially surrounds a first end portion of the bobbin. A voice coil is wound around a base portion of the bobbin, and a surround coupled to the diaphragm, with a basket coupled to the surround. The dust cap of an example is adhered to the diaphragm and the bobbin.

According to an example, an adhesive joint couples the diaphragm and the bobbin and providing a seal at the junction of the diaphragm and the bobbin. A convex surface of the dust cap, opposite the concave surface, extends into a cavity formed by the bobbin.

According to another particular aspect, a method of fabricating an electroacoustic transducer, the method includes positioning a voice coil proximate a first end portion of a bobbin and mounting a dust cap to a second end portion of the bobbin. The second end portion is opposite the first end portion, and the bobbin is coupled to a diaphragm such that the dust cap is coupled to the diaphragm via the bobbin, where the dust cap includes a concave surface that faces outwardly away from the bobbin.

According to other aspects, coupling the dust cap to the bobbin further includes applying adhesive onto at least one of the interior of the dust cap and a surface of the bobbin as the dust cap is positioned onto the bobbin. Coupling the dust cap to the bobbin further includes sliding the dust cap on top of the bobbin. In other example, coupling the dust cap to the bobbin further includes positioning the dust cap in such a manner that a height of the dust cap does not exceed a height of a speaker cone of the electroacoustic transducer. Coupling dust cap to the bobbin further includes aligning a flange surface of the dust cap with relation to an exterior surface of the bobbin.

Benefits facilitated by the inverted button cap include allowing for a smaller, thinner speaker package. The inverted button cap helps ensure a good water tight seal at the interface between the speaker cone and the bobbin. A direct coupling is ensured between the inverted button cap and the voice coil. The coupling reduces acoustic artifacts attributable to relative movements between the two components. The inverted button cap minimizes the mass needed to adequately seal the bobbin top. The inverted button cap allows for the use of a non-waterproof and permeable bobbin and collar in waterproof or other harsh applications. The inverted button cap provides additional robustness to hydrostatic water pressure and mechanical handling damage. The inverted button cap eliminates challenges with centering cone-attached dust caps during assembly. An implementation reduces challenges associated with adhesive placement with cone-attached dust caps during assembly. In some cases, the inverted dust cap is provided with a non-spherical shape, which may help push its resonance frequency higher. These and other advantages realized by the inverted dust cap are described in the detailed description and drawings.

IV. BRIEF DESCRIPTION OF THE DRAWINGS

Figure 2:
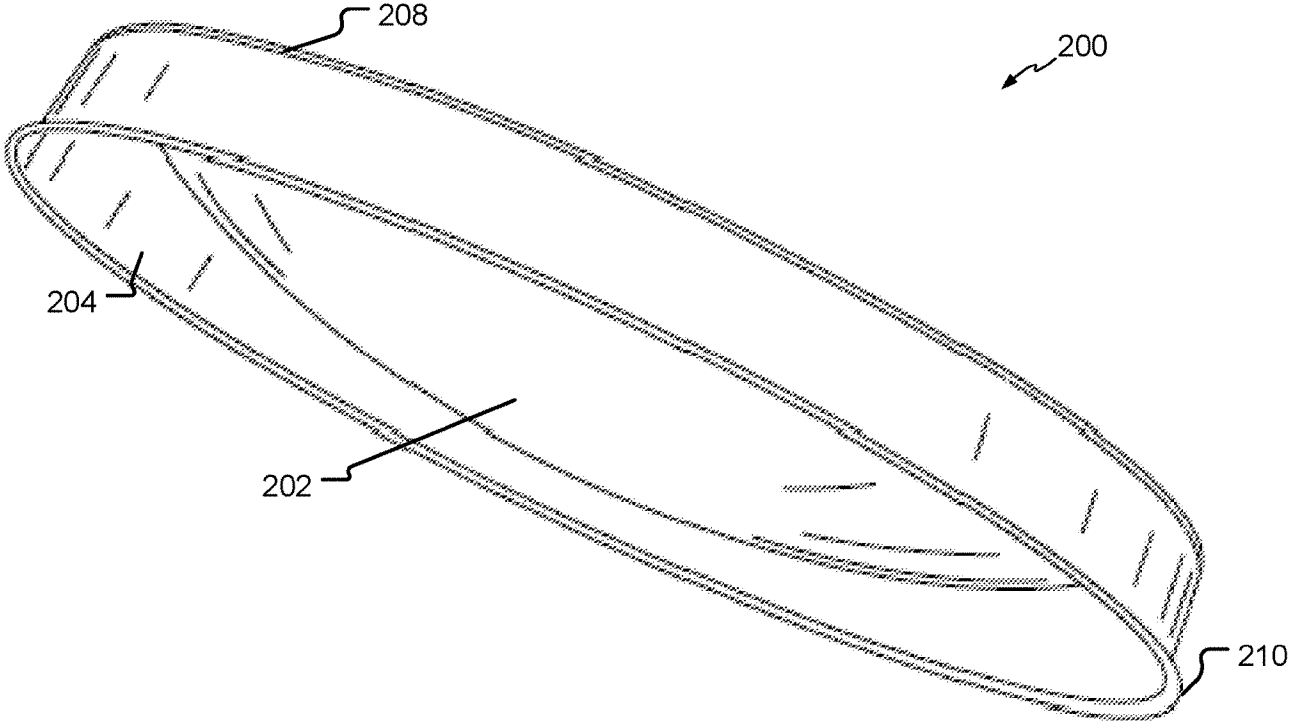

FIG. 1 is a cross-sectional view of an electroacoustic transducer that includes a concave shaped dust cap that is coupled to a bobbin; and FIG. 2 is a perspective view of a concave dust cap, similar or identical to that shown in FIG. 1.

V. DETAILED DESCRIPTION

An implementation of an inverted button cap closes off an open end of a bobbin of a speaker in a manner that alleviates disadvantages of prior art devices. More specifically, the inverted button cap has a concave surface and is configured to be attached to an outer diameter of the bobbin.

The concave surface of the inverted button cap minimizes the overall thickness of the speaker. Even when the bobbin is in a fully excursed position, the concave surface prevents the outer surface of the inverted button cap from protruding beyond the outer diameter of a speaker cone. This feature results in an overall smaller speaker package. Furthermore, the concave outer surface is less likely to buckle or invert as comparted to the convex outer surfaces found in some conventional designs. The resistance to buckling and inversion helps resist high hydrostatic pressures and minimizes the possibility of handling damage.

An implementation of the inverted button cap slides over and is secured to the outer diameter of the bobbin. The sliding and securement allows a joint between the cone and the outer diameter of the bobbin to be flooded with adhesive at the same time that the inverted button cap is secured to the bobbin. This manufacturing advantage helps ensure a watertight seal at an interface between the outer diameter of the bobbin and the cone. The watertight seal helps protect the inner transducer components, including the bobbin. Because the inverted button cap covers the adhesive between the cone neck and bobbin, the inverted button cap eliminates cosmetic concerns associated with the joint.

An additional benefit of attaching the inverted button cap to the bobbin is that it is self-aligning. The self-alignment avoids the misalignment issues encountered with a conventional dust cap. Because of the self-alignment, application of the dust cap glue is more robust to manufacturing tolerances and hence, more consistent. The attachment to the bobbin eliminates concerns with buzzing due to unwanted contact between the inside of the dust cap surface and the bobbin top. Such buzzing can be problematic in smaller transducers.

A further benefit of attaching the inverted button cap in this manner is that it couples the inverted button cap to a voice coil. This direct coupling reduces the relative movements between the voice coil and the inverted button cap. In addition, the small size of the inverted button cap increases the fundamental resonant frequency of the dust cap and minimizes the mass needed to adequately seal the open bobbin top.

Turning more particularly to the Drawings, FIG. 1 is a cross-sectional view of an electroacoustic transducer 100 that includes a dust cap 102 coupled to a bobbin 104. The dust cap 102 includes a concave surface 103 that faces outwardly away from the bobbin 104. A rim/wall, or flange surface 105, of the dust cap 102 is oriented substantially parallel to the bobbin 104 and covers a portion of the outside diameter of the bobbin 104. A convex surface 111 of the dust cap 102, opposite the concave surface 103, contours into a cavity, or dust cap volume 107, formed by the bobbin 104. The dust cap 102 is connected to the bobbin 104 using adhesive or any other suitable method of attachment that provides a relatively rigid coupling. The top of the bobbin 104 is covered by the dust cap 102, forming the dust cap volume 107 inside the bobbin 104.

The bobbin 104 is further attached to a speaker cone 106. The speaker cone 106 comprises a radiating surface of the electroacoustic transducer 100 (driven or passive). The speaker cone 106 is sometimes called a diaphragm. In other designs, the speaker cone may not be the primary radiating surface. Additionally, while the speaker cone 106 of FIG. 6 is conical, a speaker cone of another example does not necessarily have a conical shape.

In the example of FIG. 1, the cone 106 is coupled to the bobbin 104 via an adhesive joint 109. For instance, before the dust cap 102 is positioned on the bobbin 104, the bobbin 104 may be adhered to the cone 106. Once the dust cap 102 is positioned, the dust cap 102 may be adhered to the bobbin 104 and the cone 106. As such, the dust cap 102 in the example is coupled to the cone 106 via the bobbin 104. In one example (not shown), the adhesive may flood the connection between the cone, dust cap, and bobbin. The cone 106 shown in FIG. 1 is additionally coupled to a basket 110 through a surround 108. The bobbin 104 is also coupled to the basket 110 through a spider 112 and spider support 114.

A voice coil 118 is wound around the base of the bobbin 104. A pole piece 120 is sandwiched between annular magnets 122, 124. The voice coil 118, pole piece 120, and magnets 122, 124 form a linear actuator that moves the bobbin 104 and speaker cone 106.

When an electric current oscillating at an acoustic frequency is applied to the voice coil 118, electromagnetic forces between the voice coil 118 and the magnets 122, 124 cause the voice coil 118 and bobbin 104 to move linearly. The linear motion of the voice coil 118 causes the cone 106, surround 108, and dust cap 102 to move and produce acoustic radiation.

In addition to the other benefits described herein, the direct attachment of the dust cap 102 to the bobbin 104 (e.g., rather than to the cone 106), avoids undesirable movement between the dust cap 102 and the voice coil 118. The dust cap 102 is seated on the bobbin 104 and readily aligned by virtue of the lip, or flange surface 105 that wraps around a portion of a circumference the bobbin 104. The seating enables good adhesive contact, as well. The concave shape of the dust cap 102 reduces the height and exposed vulnerability of the electroacoustic transducer 100 (e.g., relative to a conventional convex dust cap configuration) while being capable of producing a large sound profile.

FIG. 2 is a perspective view of a concave dust cap 200 configured for use in an electroacoustic transducer (not shown). The concave dust cap 200 is identical or similar to the dust cap 102 of FIG. 1. The dust cap 200 of an example is constructed from aluminum, however, other materials, including plastic, are used in other implementations. The dust cap 200 includes a concave surface 206, as well as a folded back, rim/lip, or flange surface 204. The flange surface 204 may be cylindrical and circumferential. The flange surface 204 of an example fits around the outside diameter of a bobbin (not shown). The flange surface of another example is adhered to an inside diameter of the bobbin.

A lip 210 that extends out from the flange surface 204 is included in the example of FIG. 2. The lip 210 may facilitate handling and placement of dust cap 200. The lip 210 additionally provides structural rigidity to resist deformity, and facilitates an airtight and waterproof seal. For instance, a seal along the lip can form the desired seal. While the flange surface 204 of FIG. 2 is substantially perpendicular to a plane formed by the concentric top edge 208 of the dust cap 200, a flange surface of another example may extend at another angle.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but is to be accorded the widest scope consistent with the principles and novel features disclosed herein.

The invention claimed is:

1. An electroacoustic transducer comprising:

a diaphragm;

a bobbin coupled to the diaphragm;

a dust cap supported by the bobbin and coupled to the diaphragm via the bobbin, the dust cap including a concave surface that faces outwardly away from the bobbin, wherein the dust cap includes a cylindrical flange surface, wherein the flange surface contacts an exterior circumference of the bobbin; and an adhesive joint coupling the dust cap, the diaphragm, and the bobbin, wherein the adhesive joint provides a watertight seal at the junction of the dust cap, the diaphragm, and the bobbin.

2. The electroacoustic transducer of claim 1, wherein the dust cap includes a flange surface that circumferentially surrounds a first end portion of the bobbin.

3. The electroacoustic transducer of claim 1, wherein the flange surface extends in a substantially parallel direction to a surface of the bobbin.

4. The electroacoustic transducer of claim 1, wherein the dust cap includes a lip that extends outwardly from the flange surface.

5. The electroacoustic transducer of claim 1, wherein the bobbin comprises a hollow cylinder, and wherein the dust cap includes a cylindrical wall disposed around a periphery of the concave surface, wherein the cylindrical wall concentrically surrounds a first end portion of the hollow cylinder.

6. The electroacoustic transducer of claim 1, wherein a convex surface of the dust cap, opposite the concave surface, extends into a cavity formed by the bobbin.

7. An apparatus comprising:

a diaphragm;

a bobbin coupled to the diaphragm;

a dust cap supported by the bobbin and coupled to the diaphragm via the bobbin, the dust cap including a concave surface that faces outwardly away from the bobbin, wherein the dust cap includes a flange surface that circumferentially surrounds and contacts an exterior circumference at a first end portion of the bobbin;

an adhesive joint coupling the dust cap, the diaphragm, and the bobbin and providing a watertight seal at the junction of the dust cap, the diaphragm, and the bobbin;

a voice coil wound around a base portion of the bobbin;

a surround coupled to the diaphragm; and a basket coupled to the surround.

8. The apparatus of claim 7, wherein a convex surface of the dust cap, opposite the concave surface, extends into a cavity formed by the bobbin.

9. A method of fabricating an electroacoustic transducer, the method comprising:

positioning a voice coil proximate a first end portion of a bobbin;

mounting a dust cap to a second end portion of the bobbin, wherein the second end portion is opposite the first end portion, wherein the dust cap includes a cylindrical flange surface, wherein the flange surface contacts an exterior circumference of the bobbin; and coupling the dust cap, the bobbin and a diaphragm using an adhesive joint such that the dust cap is coupled to the diaphragm via the bobbin, wherein the adhesive joint provides a watertight seal at the junction of the dust cap, the diaphragm, and the bobbin, wherein the dust cap includes a concave surface that faces outwardly away from the bobbin.

10. The method of claim 9, wherein coupling the dust cap to the bobbin and the diaphragm further includes applying the adhesive onto at least one of the interior of the dust cap and a surface of the bobbin as the dust cap is positioned onto the bobbin.

11. The method of claim 9, wherein coupling the dust cap to the bobbin and the diaphragm further includes sliding the dust cap on top of the bobbin.

12. The method of claim 9, wherein coupling the dust cap to the bobbin and the diaphragm further includes positioning the dust cap in such a manner that a height of the dust cap does not exceed a height of a speaker cone of the electroacoustic transducer.

13. The method of claim 9, wherein coupling the dust cap to the bobbin and the diaphragm further includes aligning a flange surface of the dust cap with relation to an exterior surface of the bobbin.

* * * * *